US006298693B1

(12) United States Patent
Schaffer

(10) Patent No.: US 6,298,693 B1
(45) Date of Patent: Oct. 9, 2001

(54) LOOP TRANSFER NEEDLE

(75) Inventor: Oskar Schaffer, Albstadt (DE)

(73) Assignee: Groz Beckert KG, Albstadt (DE)

( * ) Notice: Subject to any disclaimer, the term of this patent is extended or adjusted under 35 U.S.C. 154(b) by 0 days.

(21) Appl. No.: 09/501,137

(22) Filed: Feb. 9, 2000

(30) Foreign Application Priority Data

Feb. 11, 1999 (DE) ..... 199 05 668

(51) Int. Cl.[7] ..... D04B 35/02
(52) U.S. Cl. ..... 66/123
(58) Field of Search ..... 66/60 R, 64, 116, 66/119, 120, 121, 122, 123, 95, 96 R

(56) References Cited

U.S. PATENT DOCUMENTS

| | | | | |
|---|---|---|---|---|
| 2,626,515 | * | 1/1953 | Pierre | 66/123 |
| 2,667,770 | * | 2/1954 | Sirmay | 66/123 |
| 4,580,419 | * | 4/1986 | Vincoli | 66/123 |
| 4,612,786 | * | 9/1986 | Perotti | 66/123 |
| 4,646,542 | * | 3/1987 | Tenconi | 66/121 |

FOREIGN PATENT DOCUMENTS

| | | |
|---|---|---|
| 681136 | 10/1952 | (DE) . |
| 1 560 996 | 7/1971 | (DE) . |
| 28 47 972 | 3/1980 | (DE) . |
| 31 45 798 | 2/1985 | (DE) . |
| 34 01 874 | 7/1985 | (DE) . |
| 42 31 015 | 4/1997 | (DE) . |

* cited by examiner

*Primary Examiner*—Danny Worrell
(74) *Attorney, Agent, or Firm*—Venable; Gabor J. Kelemen

(57) ABSTRACT

A transfer needle for loop forming machines includes an elongated needle shank having a needle back, an outer side face and a top face opposite the needle back; a transfer spring attached to the needle shank and defining an intermediate space therewith; and a lateral recess provided in the needle shank and forming part of the intermediate space. The recess is defined by a guide face extending from the needle back to the outer side face of the needle shank. The guide face includes a first length portion bordering the outer side face of the needle shank and extending toward the needle back; and a second length portion bordering the needle back and extending toward the outer side face of the needle shank. The first and second length portions meet in an obtuse angle open toward the transfer spring.

12 Claims, 5 Drawing Sheets

LOOP TRANSFER NEEDLE

CROSS REFERENCE TO RELATED APPLICATION

This application claims the priority of German Application No. 199 05 668.4 filed Feb. 11, 1999, which is incorporated herein by reference.

BACKGROUND OF THE INVENTION

This invention relates to a transfer needle for loop-forming machines making flat textile knitwear.

For making, for example, patterned knitwear, circular knitting machines with cylinder needles and dial needles may be used. Dependent on the pattern, individual loops are transferred from the cylinder needles to the dial needles and conversely. For this purpose special needles are used which have loop transfer elements and are designated as transfer needles.

German Patent No. 42 31 015 discloses transfer needles configured as compound needles which have a slide extending longitudinally along the needle shank and serve for opening and closing a hook (head) carried by the needle shank. A transfer spring secured to the side of the compound needle defines with the needle shank an intermediate space through which the hook and the shank of another needle may pass. The transfer spring is held only at one of its ends on the needle shank. For a suitable configuration of the intermediate space between the transfer spring and the needle shank the latter is provided with a recess which intersects the slide as well as the shank.

The intersecting faces of the slide and the shank each form guide faces which are to facilitate the penetration of another needle into the intermediate space.

German Patent No. 1,560,996 discloses a transfer needle which is configured as a latch needle rather than a compound needle. Accordingly, it has a solid needle shank without a slide element. To effect loop transfer, the latch needle has a laterally bent shank. That part of the shank which extends from the hook and which is designated as the main shank is of stepped structure having a high and a low portion. Starting from the low portion, a groove extends over the needle back to the high shank portion in which the groove is entirely open towards the side face of the needle.

A lateral bent portion of the shank is, however, in many instances undesirable.

German Patent No. 31 45 708 discloses a transfer needle for flat knitting machines. The needle has a transfer spring on its side for transferring the loops. The spring is a leaf spring and is affixed at one of its ends to the needle shank. The other, free end of the leaf spring forms, together with the needle shank, an intermediate space into which another needle may penetrate with its hook and shank. The leaf spring as well as the needle shank are, at their respective underside, provided with an oblique guide face which is intended to facilitate the penetration of another needle into the intermediate space between the transfer spring and the needle shank. The guide face provided on the shank is substantially planar and extends from the needle back to the outer side face of the needle.

Particularly the transfer spring of the transfer needle is exposed to substantial dynamic loads during operation. For the loop transfer first the hook and one part of the shank of another transfer needle enters the intermediate space in the vicinity of the free end of the transfer spring. This event may already cause the free end of the transfer spring to be pushed away laterally from the needle shank at which the transfer spring is secured. If such an occurrence takes place in a narrow needle guide channel where the transfer spring lies against the channel flanks, the transfer spring may undergo substantial local bending deformations which lead to high stresses. If such an occurrence causes breakage of the spring, the transfer needle becomes useless, and the knitting machine has to be stopped for servicing.

SUMMARY OF THE INVENTION

It is an object of the invention to provide an improved transfer needle of the above-outlined type whose service life is lengthened.

This object and others to become apparent as the specification progresses, are accomplished by the invention, according to which, briefly stated, the transfer needle for loop forming machines includes an elongated needle shank having a needle back, an outer side face and a top face opposite the needle back; a transfer spring attached to the needle shank and defining an intermediate space therewith; and a lateral recess provided in the needle shank and forming part of the intermediate space. The recess is defined by a guide face extending from the needle back to the outer side face of the needle shank. The guide face includes a first length portion bordering the outer side face of the needle shank and extending toward the needle back; and a second length portion bordering the needle back and extending toward the outer side face of the needle shank. The first and second length portions of the guide face meet in an obtuse angle which is open toward the transfer spring.

Thus, the transfer needle according to the invention has at its side face a recess which is covered by a transfer spring. The transfer spring is, at one of its ends, connected with the needle shank and has a preferably pointed tongue which lies in a depression of the needle shank. The recess positively defines a guide face at the needle shank along which a penetrating hook of another needle may slide. The guide face extends along the recess from the needle back to the lateral needle face, while its angle formed with the needle back changes. Stated differently, the guide face has a first portion adjoining the needle back and a second portion adjoining the lateral needle face, and the two portions form an obtuse angle with one another, whereby the guide face is concave. This measure prevents an excessive weakening of the needle shank in the region of the recess. This measure also permits an enlargement of the depth of the recess compared to conventional configurations without causing an excessive weakening of the needle shank. Also, the displacement/time relationship concerning the excursion of the transfer spring may be positively affected, and a spring breakage is prevented which could otherwise occur as a result of dynamic loads on the transfer spring, particularly in the region of its free end. The service life or service expectancy of such a transfer needle is thus lengthened.

The transfer needle according to the invention may be configured such that the guide face forms, in vicinity of the needle back, a small angle with the principal direction of motion of a penetrating transfer needle. In this manner a penetrating transfer needle is relatively slowly deflected laterally and is relatively gradually accelerated. Thus, not only the transfer spring but also the penetrating transfer needle is gently handled.

Due to the particular configuration of the guide face, in the transfer needle according to the invention a smooth transition from the upper side (top face) of the needle to the outer side face thereof for forming the loop support edge is not affected. The depth of the penetration space, however, may be enlarged. The recess may be configured such that it terminates at the side face of the transfer needle. By virtue of this arrangement, in this region the loop supporting edge may configured without a profile change caused by the recess. This ensures that the loops glide gently and without damage over the loop supporting edge.

The concave shape of the guide face may be obtained in various ways. For example, the guide face may be at least partially arcuate in the longitudinal direction of the transfer needle. Additionally, the guide face may be at least partially arcuate or kinked at least once in a direction defined by the penetrating motion of another transfer needle. The curvature may be circular, parabolic or of any other shape. In any event, the recess may be deeper than it has been possible heretofore without adversely affecting the loop supporting edge or the stability of the loop forming region of the transfer needle. It has been found that the depression, compared to transfer needles having a linear guide face could be deepened by 0.1 mm at the height of the bottom edge of the transfer spring, corresponding at least to one-half of the thickness of the transfer spring. By making the depression deeper, the displacement/time relationship of the motion of the transfer needles and their parts during the loop transfer step is positively influenced in that the transfer spring bends to a lesser extent which means a relief of the transfer spring. Further, the introducing step is facilitated by the enlargement of the space between the transfer spring and the guide face; as a result, more space is provided for the penetrating transfer needle.

In the alternative, and in principle with the same effect, the guide face may have a kink line defined by two essentially planar surface regions.

The angle which the lower part of the guide face (in the vicinity of the needle back) forms with a line which is perpendicular to the needle back is preferably less than 20° (preferably 18°), and such an angle for the upper part of the guide face (which borders the lateral needle face) is preferably more than 20°. On the outer side face of the needle the angle is preferably substantially greater and amounts to, for example 25° or even more than 30°. The depth of the depression may so dimensioned that at the needle back it occupies more than one-half of the width of the transfer needle. At the height of the bottom edge of the transfer spring the depth of the depression is, however, preferably less than one-half of the shank thickness. At this height a kink line may be arranged at which the inclination of the guide face changes. In the alternative, a curved part of the guide face may start or may terminate at that location.

Advantageous geometrical conditions and advantageous conditions for the motion of the penetrating transfer needle are obtained when the depression on the needle back occupies more than one-half the width of the transfer needle. The transition of the guide face from a first angular orientation to a further angular orientation preferably occurs essentially at the height of the lower edge of the transfer spring.

DESCRIPTION OF THE PREFERRED EMBODIMENT

Figure 1:
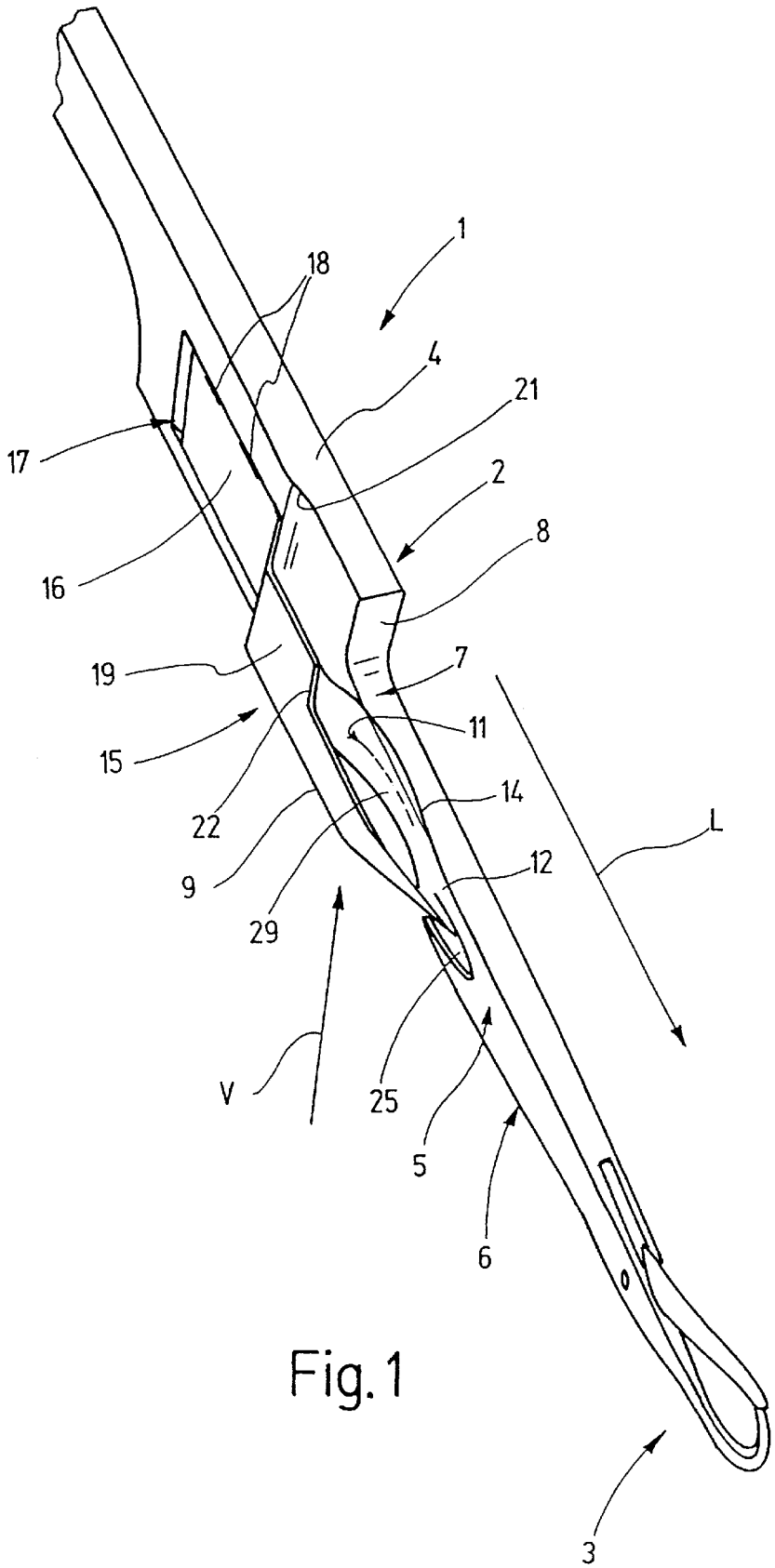
FIG. 1 is a simplified perspective view of one part of the transfer needle incorporating the invention.

FIG. 1 shows a transfer needle 1 including a shank 2, a head 3 and the associated elements. The needle butt is not shown. The shank 2 is divided into a high length portion 4 and a low length portion 5. Both length portions 4 and 5 extend upwardly from a common needle back 6. The transition from the high length portion 4 of the shank 2 to its low length portion 5 is formed by a step 8. On either side of the step 8 the shank 2 extends without a bend and linearly in the longitudinal direction L which coincides with the principal direction of motion of the transfer needle 1.

Figure 2:
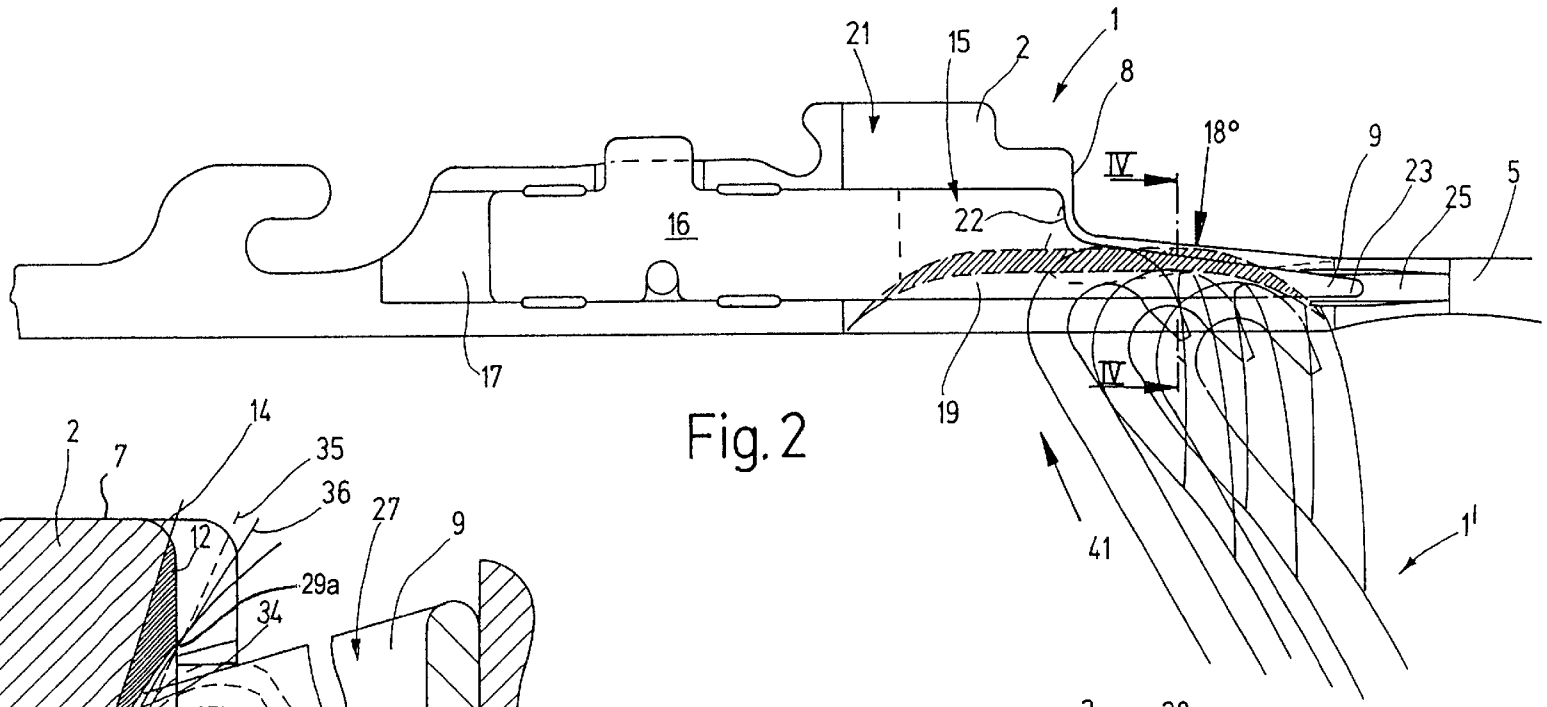
FIG. 2 is a side elevational view of one part of the transfer needle shown in FIG. 1.

In the needle shank 2, in the zone of the transition between the length portions 4 and 5, that is, approximately underneath the step 8, a recess 11 is provided which serves for receiving the head 3 of another transfer needle 1', as particularly well seen in FIG. 2. The recess 11 constitutes a lateral opening in the shank 2 and thus extends from the needle back 6 to an outer needle side face 12 extending between the needle back 6 and the upper needle surface (top face) 7. Between the outer side face 12 and the top face 7 of the needle a loop supporting edge 14 is formed which is spaced from the recess 11.

The recess 11 is substantially covered by a transfer spring 15 which is a leaf spring having a linear, essentially rectangular mounting portion 16 held in a lateral depression 17 of the needle shank 2, for example, by means of a plurality of embossments 18. Starting from an end of the mounting portion 16 the transfer spring 15 is offset from the needle shank 2, whereby a further length portion 19 of the transfer spring 15 extends parallel to and at a distance from the remaining needle shank 2. In the corresponding zone adjacent the spring length portion 19 the shank 2 may have a slightly reduced thickness. Thus the shank 2, starting from a location 21 situated at the start of the offset of the spring 15, is slightly narrower than in the remaining shank regions.

Figure 3:
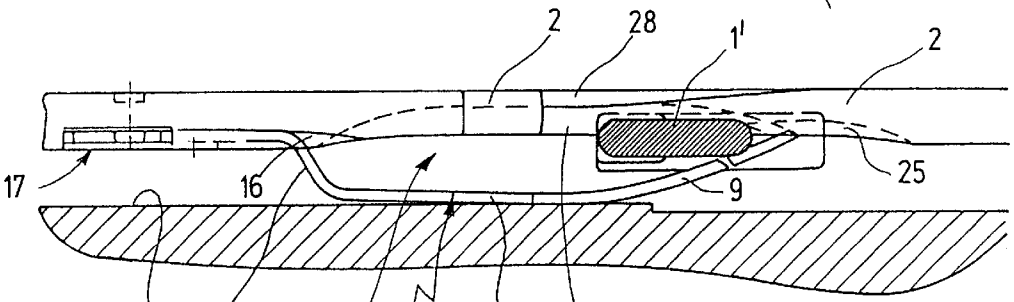
FIG. 3 is a top plan view of one part of the needle shown in FIG. 2, also showing a channel side wall contacted by the transfer needle.

The height of the length portion 19 of the transfer spring 15 is reduced in the length direction L of the shank 2 with a step 22 approximately at the same location where the height of the shank 2 is reduced. Such an arrangement is particularly well seen in FIG. 2 which illustrates the transfer needle 1 in side elevation. Starting from the step 22 the transfer spring 15 is further reduced so that eventually it ends approximately in a point at its terminus 23. The bent configuration of the transfer spring 15 may be best observed in FIG. 3: The transfer spring 15 extends, starting from the bend 24, approximately parallel to the shank 2; the tapering portion with its end 23 is bent towards the shank 2 and lies under bias in a groove 25 provided in the shank 2. Between the length portion 19 and an adjoining, tapering length portion 9 of the transfer spring 15 and the shank 2 thus an intermediate penetration chamber 27 is formed. Between the bend 24 of the transfer spring 15 and the step 22 of the needle shank 2 the transfer spring 15 has the planar, plate-like length portion 19. The latter and/or the length portion 9 engages a flank F of a needle channel or may contact the flank F at least at one location of the spring 15.

Opposite the recess 11 on the top face 7 of the shank 2 a cutout 28 is formed which extends into the adjoining lateral shank surface and which serves for guiding the loops lying on the shank 2. Since the cutout 28 is situated opposite the recess 11, a reduction of the cross section of the shank 2 is obtained. In order to maintain such a reduction to a possibly small value, the relatively larger recess 11 has a specific shape as shown in FIG. 4.

The recess 11 is bordered towards the shank 2 by a guide face 29 which extends at the needle back 6 in an acute angle to the direction V (FIGS. 1 and 4) which, in turn, is oriented at 90° to the needle back 6 and is indicating approximately the direction in which a penetrating transfer needle 1' (FIG. 3) is moved. The guide face 29 is concave relative to the lateral needle face 12. The guide face 29 has a first surface region 31 which adjoins immediately the needle back 6 and a central surface region which is at least approximately planar. In the longitudinal direction L the recess 11 terminates in a preferably planar shape at both ends; the surface region 31 may be slightly arcuate.

Referring once again to FIG. 4, approximately at the same height as a linearly extending bottom edge 32 of the transfer spring 15, the guide face 29 changes its angle of inclination. It changes at a kink line 33, for example, into a planar second surface region 34 which is inclined at an angle larger than 25°, for example, 30° to the direction V. For illustrating the effect of this measure, a broken line 35 shows the course of a guide face which would result in case of an angle of 25°. It is seen that the recess is significantly smaller. The additionally obtained free space of the recess is designated at 30. In contrast, a throughgoing arrangement of the guide face 29 at an angle of 18° would result in the guide face 29 reaching the loop supporting edge 14. By subdividing the guide face 29 into two planar or curved surface regions 31 and 34 arranged at an obtuse angle to one another, the cross-sectional region of the shank 2 shown closely shaded in FIG. 4 ensures a stability of the shank 2. The depth 30 of the recess 11, measured at the bottom edge 32 of the transfer spring 15, is significantly enlarged compared to a throughgoing guide surface having an angle of 25°. The increase of the depth of the recess 11 may be more than one-half of the thickness of the transfer spring 15. The guide face 29 has an overall concave shape, which reduces the dynamic loads of the transfer spring 15. The arrangement of such an overall concave shape may be explained with reference to FIG. 4 as follows: the earlier-noted broken straight line 35 may also be regarded as connecting an upper edge 29*a* of the guide face 29 lying in the lateral needle face 12 and a lower edge 29*b* lying in the needle back 6. It is seen that the entire guide face 29 as viewed cross-sectionally in FIG. 4 is situated solely on one side of the broken line 35 and furthermore, as viewed between the edges 29*a* and 29*b*, the cross-sectionally viewed guide face 29 is throughout of concave configuration.

Figure 4:
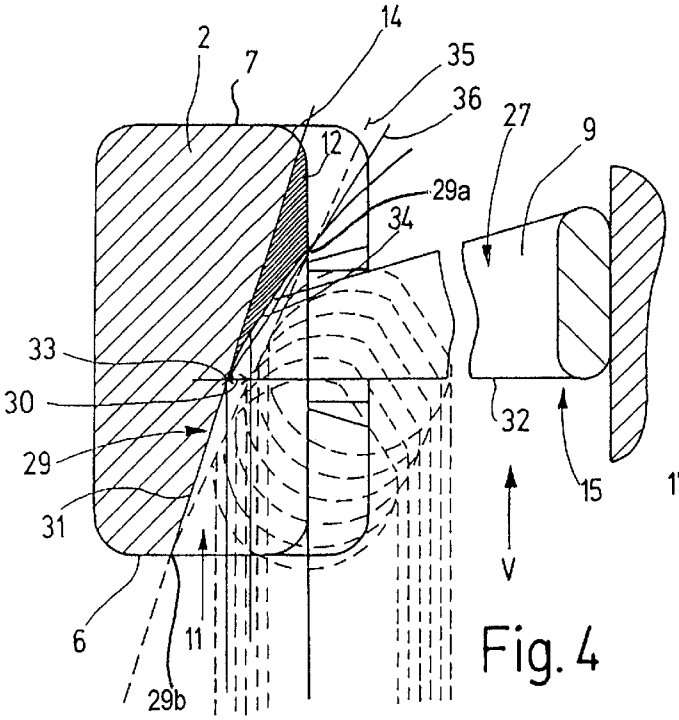
FIG. 4 is a sectional view taken along line IV—IV of FIG. 2.

The second surface region 34, as indicated with a line 36 in FIG. 4, may be planar, that is, it may be straight within the sectional plane. It may, however, also have a radius R, that is, it may be of arcuate shape. The radius of curvature may be constant. In the alternative, the radius of curvature may change as a function of the angle so that curvatures different from a circular arc may be obtained.

In the description which follows, the operation of the above-described transfer needle 1 will be set forth, particularly in conjunction with FIG. 2.

Figures 5A, 5B:
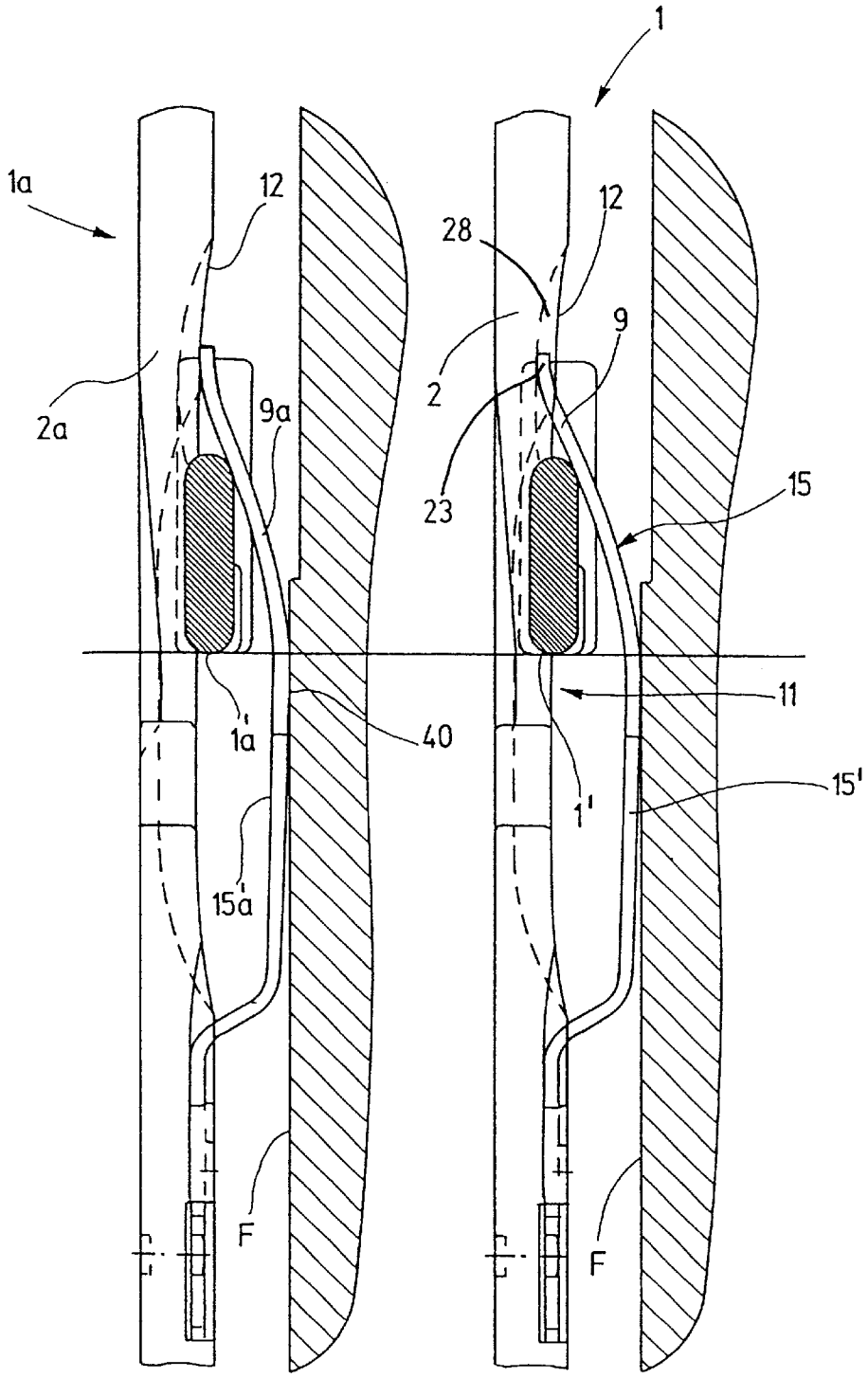
Fig. 5a (PRIOR ART)
FIGS. 5*a*, 6*a* and 7*a* are top plan views of a conventional transfer needle shown in different operational positions.
FIGS. 5*b*, 6*b* and 7*b* are top plan views of a transfer needle according to the invention shown in the same operational positions as those illustrated in the respective FIGS. 5*a*, 6*a* and 7*a*.

For transferring loops which lie on the length portion 5 of the shank 2, another transfer needle 1' penetrates into the chamber 27 at which time the end 23 of the transfer spring 15 lies in the groove 25 of the shank 2. FIGS. 5*a* and 5*b* compare a transfer needle 1 according to the invention (FIG. 5*b*) with a conventional transfer needle 1*a* (FIG. 5*a*) at the beginning of the penetration by another transfer needle shown in section and designated at 1' and 1'*a,* respectively. Based on the deepening of the recess 11 because of the subdivision of the guide faces compared to the conventional transfer needle 1*a,* the end 23 of the transfer spring 15 does not lift off the shank 2 of the transfer needle 1, in contrast to the transfer needle 1*a*.

Figures 6A, 6B:
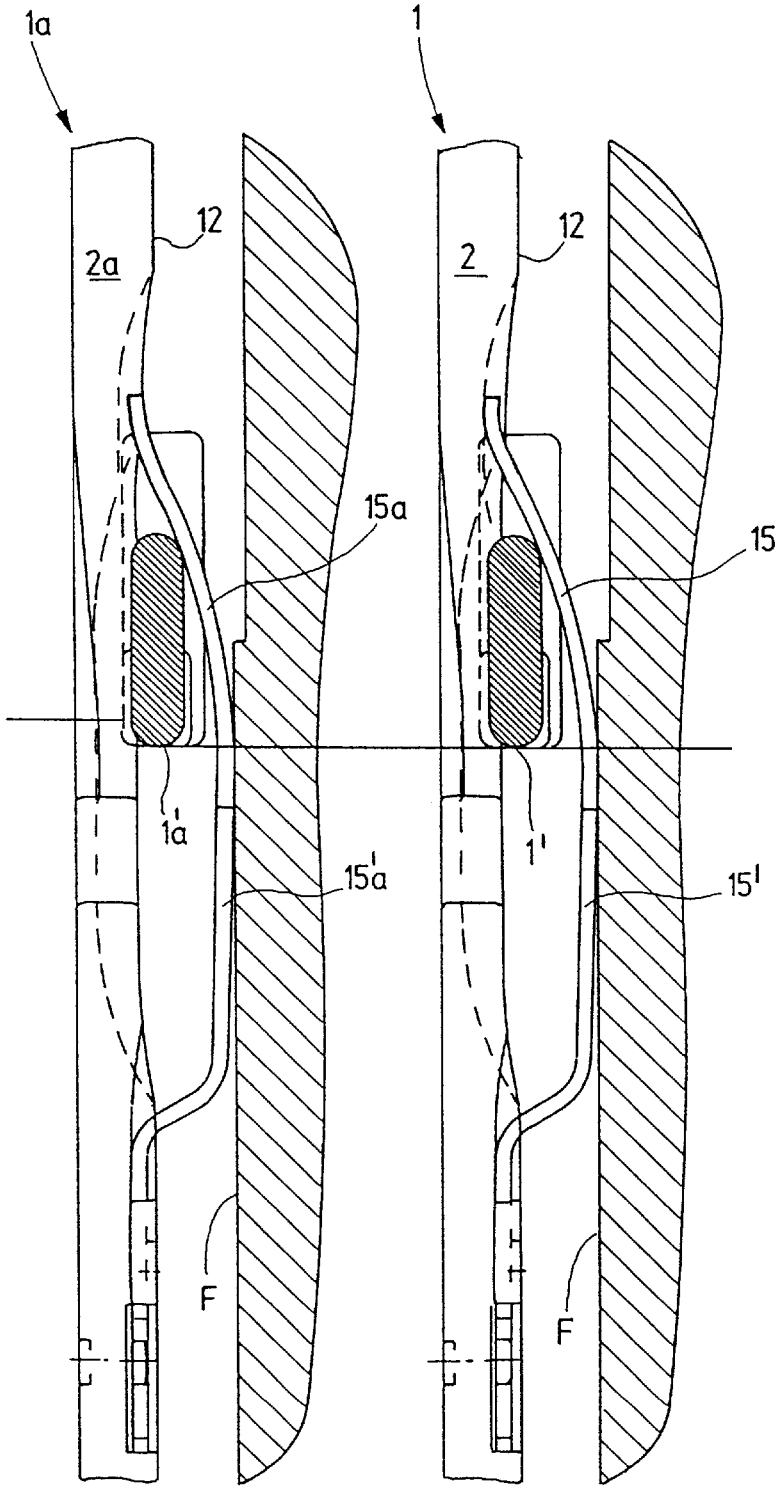
Fig. 6b (PRIOR ART)
Figures 7A, 7B:
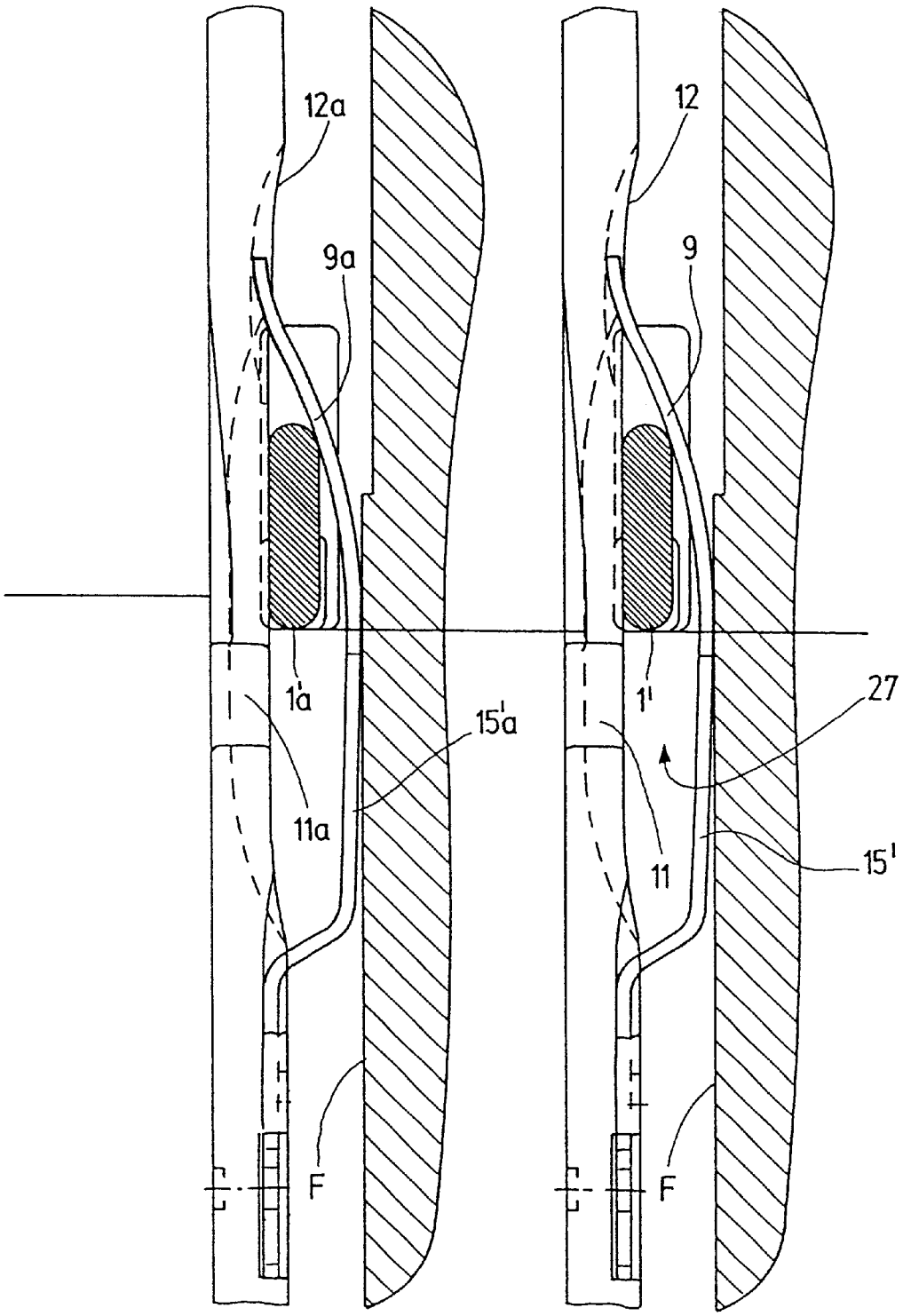
Fig. 7a (PRIOR ART)

Thus, the conditions are different in the transfer needle la according to the prior art as illustrated in FIGS. 5*a*, 6*a* and 7*a*.

As seen in FIG. 5*a*, at the beginning of the penetrating step the transfer spring 15*a* of the conventional transfer needle la is lifted from the needle shank 2*a* by the penetrating transfer needle 1*a'*. The transfer spring 15*a* is pushed against the flank F of the needle channel in which the transfer needle 1*a* runs. The support point onto which the transfer spring 15*a* runs onto the flank F is designated at 40. There is obtained a short leverage length of the outwardly moved portion of the transfer spring 15*a* at the tapering portion 9*a* of the transfer spring 1*a*. This results in a high material stress which, as shown in FIG. 5*b*, is avoided in the transfer needle 1 according to the invention.

The penetration step shown in FIG. 2 in side elevation first starts in the vicinity of the free end of the transfer spring 15. Upon penetration, the penetrating transfer needle 1' is moved in the direction of the obliquely upward directed arrow 41. Accordingly, in the course of the penetrating step, the penetrating transfer needle 1' or 1*a'* moves away from the free end 23 of the respective transfer spring 15 or 15*a*. As the penetrating step progresses, the transfer spring 15 of the transfer needle 1 according to the invention (FIG. 6*b*) is in engagement with the shank 2 as before, while the conventional transfer needle 1*a,* as shown in FIG. 6*a*, is lifted off the shank 2 as before.

Only as the penetrating step further progresses, as shown in FIGS. 7*a* and 7*b*, does the penetrating transfer needle 1' advance into the penetrating chamber 27 to such an extent that it leaves the guide face 29 with its head and reaches the side face 12 of the transfer needle 1. At the same time, the penetrating transfer needle 1' has advanced to such an extent in the direction of the arrow 42 (FIG. 2) that it reaches a region of sufficient distance between the transfer spring 15 and the side face 12 to be able to move forward without causing an appreciable excursion of the transfer spring 15. The penetrating step performed by the transfer needle 1' is optimized to such an extent by virtue of the shape of the guide face 29 altered by the invention that the bending stress of the transfer spring 15 is reduced compared to the prior art and thus the service life of the needle is lengthened.

It will be understood that the above description of the present invention is susceptible to various modifications, changes and adaptations, and the same are intended to be comprehended within the meaning and range of equivalents of the appended claims.

What is claimed is:

1. A transfer needle for loop forming machines, comprising (a) an elongated needle shank having a needle back, an outer side face and a top face opposite said needle back;

(b) a transfer spring attached to said needle shank and defining an intermediate space therewith; and (c) a lateral recess provided in said needle shank and forming part of said intermediate space; said recess being defined by a guide face extending from said needle back to said outer side face; said guide face having a first border edge lying in said outer side face and a second border edge lying in said needle back; said guide face being situated entirely on one side of an imaginary straight line connecting said first border edge with said second border edge; said guide face being solely concave in its entirety as viewed between said first and second border edges; said guide face including (1) a first length portion bordering said outer side face and extending toward said needle back; and (2) a second length portion bordering said needle back and extending toward said outer side face; said first and second length portions meeting in an obtuse angle open toward said transfer spring.

2. A transfer needle for loop forming machines, said transfer needle having a length dimension and a further dimension extending perpendicularly to said length dimension; said transfer needle comprising (a) an elongated needle shank having a needle back, an outer side face and a top face opposite said needle back; said further dimension extending parallel to said outer side face;

(b) a transfer spring attached to said needle shank and defining an intermediate space therewith; and (c) a lateral recess provided in said needle shank and forming part of said intermediate space; said recess being defined by a guide face extending from said needle back to said outer side face; said guide face being at least partially curved as viewed parallel to said further dimension; said guide face including (1) a first length portion bordering said outer side face and extending toward said needle back; and (2) a second length portion bordering said needle back and extending toward said outer side face; said first and second length portions meeting in an obtuse angle open toward said transfer spring.

3. A transfer needle for loop forming machines, said transfer needle having a length dimension and a further dimension extending perpendicularly to said length dimension; said transfer needle comprising (a) an elongated needle shank having a needle back, an outer side face and a top face opposite said needle back; said further dimension extending parallel to said outer side face;

(b) a transfer spring attached to said needle shank and defining an intermediate space therewith; and (c) a lateral recess provided in said needle shank and forming part of said intermediate space; said recess being defined by a guide face extending from said needle back to said outer side face; said guide face forming a first angle less than 20° with said further direction at said needle back and a second angle greater than 20° with said further direction at said outer side face; said guide face including (1) a first length portion bordering said outer side face and extending toward said needle back; and (2) a second length portion bordering said needle back and extending toward said outer face; said first and second length portions meeting in an obtuse angle open toward said transfer spring.

4. The transfer needle as defined in claim 1, wherein said recess terminates on said outer side face at a distance from said top face, whereby between said top face and said outer side face a throughgoing loop supporting edge is formed in a region of said recess.

5. The transfer needle as defined in claim 1, wherein said transfer needle has a length dimension; further wherein said guide face is curved as viewed parallel to said length dimension.

6. The transfer needle as defined in claim 2, wherein said guide face is circularly curved.

7. The transfer needle as defined in claim 2, wherein said guide face is parabolically curved.

8. The transfer needle as defined in claim 1, wherein said guide face has at least one kink line extending parallel to said length dimension.

9. The transfer needle as defined in claim 3, wherein said second angle is greater than 25°.

10. The transfer needle as defined in claim 3, wherein said second angle is greater than 30°.

11. The transfer needle as defined in claim 1, wherein at said needle back said recess is more than one half a width of said transfer needle.

12. The transfer needle as defined in claim 1, wherein said transfer spring has a bottom edge and said first and said second length portions meet in a kink line; said kink line determining a transition of said guide face from a first angular orientation to a second angular orientation; said transition being situated essentially at a level of said bottom edge.

* * * * *